US010306979B2

(12) United States Patent
Boone

(10) Patent No.: US 10,306,979 B2
(45) Date of Patent: Jun. 4, 2019

(54) SYSTEM AND METHOD FOR FLAT PACKED FURNITURE TO ENABLE REUSE OF PACKAGING MATERIALS

(71) Applicant: David Oliver Boone, Chesapeake, VA (US)

(72) Inventor: David Oliver Boone, Chesapeake, VA (US)

( * ) Notice: Subject to any disclaimer, the term of this patent is extended or adjusted under 35 U.S.C. 154(b) by 0 days.

(21) Appl. No.: 15/584,924

(22) Filed: May 2, 2017

(65) Prior Publication Data

US 2017/0318960 A1 Nov. 9, 2017

Related U.S. Application Data

(60) Provisional application No. 62/332,432, filed on May 5, 2016.

(51) Int. Cl.

| | |
|---|---|
| ***A47B 47/00*** | (2006.01) |
| ***A47B 96/20*** | (2006.01) |
| *B65D 77/08* | (2006.01) |
| *B65D 81/07* | (2006.01) |
| *B65D 81/133* | (2006.01) |

(52) U.S. Cl.

CPC ..... *A47B 47/00* (2013.01); *A47B 96/20* (2013.01); *B65D 77/08* (2013.01); *B65D 81/07* (2013.01); *B65D 81/133* (2013.01); *B65D 2585/647* (2013.01)

(58) Field of Classification Search

CPC ..... A47B 3/12; A47B 37/00; A47B 47/00; A47B 96/20; A47B 47/0066; A47B 47/0075; A47B 47/0091; A47B 67/00; A47B 67/04; A47C 4/00; A47C 4/02; A47C 4/028; A47C 4/03; B65D 5/42;

(Continued)

(56) References Cited

U.S. PATENT DOCUMENTS 4,032,063 A * 6/1977 Davis ..... B65D 5/321 206/326
4,077,517 A * 3/1978 Hilemn ..... A47C 4/02 206/577

(Continued)

FOREIGN PATENT DOCUMENTS

GB 2520509 A * 5/2015 ..... A47B 3/06
JP 7305296 A * 8/2013 ..... B65D 85/62
KR 1020130094427 A * 8/2013 ..... A47B 47/00

OTHER PUBLICATIONS

Cabinet Giant—Snowhaven Base Cabinet—Catalogue—Available on Aug. 15, 2014; 1 page, Retrieved from Internet <http://www.cabinetgiant.com/kitchen_cabinets/cabinets/dimenision/snowhaven/base-cabinets/sw-b12-dimension-cabinets-snowhaven-base-cabinet.html>.

*Primary Examiner* — Bryon P Gehman
(74) *Attorney, Agent, or Firm* — Olav M. Underdal IDP Patent Services

(57) ABSTRACT

A flat packed furniture system includes a plurality of boxes, each comprising a packaging piece and a set of furniture parts, such that the set of furniture parts is flat packed inside the packaging piece, such that a plurality of parts in the plurality of boxes is configured to be assemblable as a furniture item, which can be a cabinet, such that a plurality of packaging pieces in the plurality of boxes is configured to be reused as packaging for the furniture item. Also disclosed is a method for flat packing furniture, including flat packing, shipping, unpacking, assembling, repacking, and reshipping.

23 Claims, 7 Drawing Sheets

(58) Field of Classification Search
CPC ..... B65D 5/62; B65D 77/08; B65D 81/07; B65D 81/133; B65D 85/00; B65D 2585/647
USPC ..... 206/326, 577; 297/440.1–440.24
See application file for complete search history.

(56) References Cited

U.S. PATENT DOCUMENTS

| | | | | |
|---|---|---|---|---|
| 4,154,492 | A | 5/1979 | Dunning | |
| 4,169,639 | A | 10/1979 | Zola | |
| 4,243,282 | A | 1/1981 | Densen | |
| 4,287,837 | A | 9/1981 | Bayles | |
| 4,836,626 | A | 6/1989 | Taylor et al. | |
| 5,398,159 | A | 3/1995 | Andersson et al. | |
| 5,662,399 | A | 9/1997 | Henkel et al. | |
| 6,056,121 | A * | 5/2000 | Olson | B65D 5/5059 206/326 |
| 6,138,832 | A * | 10/2000 | Hunter | B65D 71/00 206/577 |
| 7,032,747 | B2 * | 4/2006 | Boche | B65D 71/0096 206/326 |
| 7,748,528 | B2 * | 7/2010 | Anderson | B65D 5/5035 206/326 |
| 9,213,367 | B1 | 12/2015 | Nelson et al. | |
| 9,380,877 | B2 * | 7/2016 | Brandtner | A47C 4/02 |
| 10,076,185 | B1 * | 9/2018 | Bennett | A47B 67/04 |
| 2003/0155847 | A1 | 8/2003 | Henkel | |
| 2004/0095000 | A1 | 5/2004 | Durling | |
| 2008/0120945 | A1 | 5/2008 | Holbrook et al. | |
| 2010/0277046 | A1 | 11/2010 | Kuo | |
| 2013/0080286 | A1 | 3/2013 | Rotholz | |
| 2017/0164730 | A1 * | 6/2017 | Lee | A47B 37/00 |

* cited by examiner

Modular Flat Packed Furniture System

Method for flat packing furniture

Locations

SYSTEM AND METHOD FOR FLAT PACKED FURNITURE TO ENABLE REUSE OF PACKAGING MATERIALS

CROSS-REFERENCE TO RELATED APPLICATIONS

This application claims the benefit of U.S. Provisional Application No. 62/332,432, filed May 5, 2016.

FIELD OF THE INVENTION

The present invention relates generally to the field of flat packed furniture, and more particularly to methods and systems for flat packing to reduce shipping cost.

BACKGROUND OF THE INVENTION

Flat packing of cabinets and furniture is generally done for the purpose of reducing logistics/transportation costs from the manufacturing/distribution source to the user/consumer.

The packaging design has as a principal purpose of ensuring that the product can get to the desired location without damage. The packaging of many products is designed with the DIY consumer in mind and does not consider reuse of any of the packaging materials.

A furniture product that is designed to be initially shipped as a flat packed product may require multiple flat pack boxes to make a specific assembled stock keeping unit (SKU). Generic sub-assemblies can be used across multiple SKUs and may be packed independently of sub-assemblies that are unique to a specific SKU. These types of products may be referred to as modular flat packed products.

A growing market is emerging, particularly with more expensive materials/products, where the flat packed product is shipped to a reseller/dealer; the reseller/dealer assembles the product, repackages the product as an assembly and delivers it or arranges delivery to the consumer or the jobsite. The kitchen cabinet industry is an example where this trend is growing.

However, this process entails packaging the product twice, and since there is generally no reuse of materials, the manufacturer will consequently incur significant material and labor costs for repackaging.

As such, considering the foregoing, it may be appreciated that there continues to be a need for novel and improved devices and methods for flat packing of cabinets and furniture with reduced logistics/transportation costs.

SUMMARY OF THE INVENTION

The foregoing needs are met, to a great extent, by the present invention, wherein in aspects of this invention, enhancements are provided to the existing model of flat packing of cabinets and furniture.

In an aspect, a flat packed furniture system can include a plurality of boxes; wherein each box in the plurality of boxes comprises a packaging piece and a set of furniture parts, such that the set of furniture parts is flat packed inside the packaging piece; such that a plurality of parts in the plurality of boxes is configured to be assemblable as a furniture item; such that a plurality of packaging pieces in the plurality of boxes is configured to be reused as packaging for the furniture item.

In a related aspect, the plurality of boxes can further include:

a) a first box, comprising:
   i. a first packaging piece; and
   ii. a first set of furniture parts, wherein the first set of furniture parts is packaged inside the first packaging piece;

b) A second box, comprising:
   i. a second packaging piece; and
   ii. a second set of furniture parts, wherein the second set of furniture parts is packaged inside the second packaging piece;

c) a third box, comprising:
   i. a third packaging piece;
   ii. a fourth packaging piece; and
   iii. a third set of furniture parts, wherein the third set of furniture parts is packaged inside the third and fourth packaging pieces;

wherein the first, second, and third sets of furniture parts are configured to be assemblable as a furniture item;

such that the packaging pieces are configured to be reused as packaging for the furniture item, such that the packaging pieces are configured to cover outer surfaces of the assembled furniture item.

In an aspect, a method for flat packing furniture, can include:

a) Flat packing a furniture item, wherein a plurality of parts for a furniture item are flat packaged inside a plurality of packaging pieces, producing a plurality of boxes;
b) Shipping the flat packed furniture item, wherein the plurality of boxes is shipped from a manufacturing location to a reseller location;
c) Unpacking the flat packed furniture item, wherein the plurality of parts is unpackaged from the plurality of boxes;
d) Assembling the furniture item, wherein the furniture item is assembled from the plurality of parts;
e) Re-packing the assembled furniture item, wherein the assembled furniture item is re-packaged with the plurality of packaging pieces; and
f) Re-shipping the assembled furniture item, wherein the re-packaged furniture item is shipped from the reseller location to a customer location.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
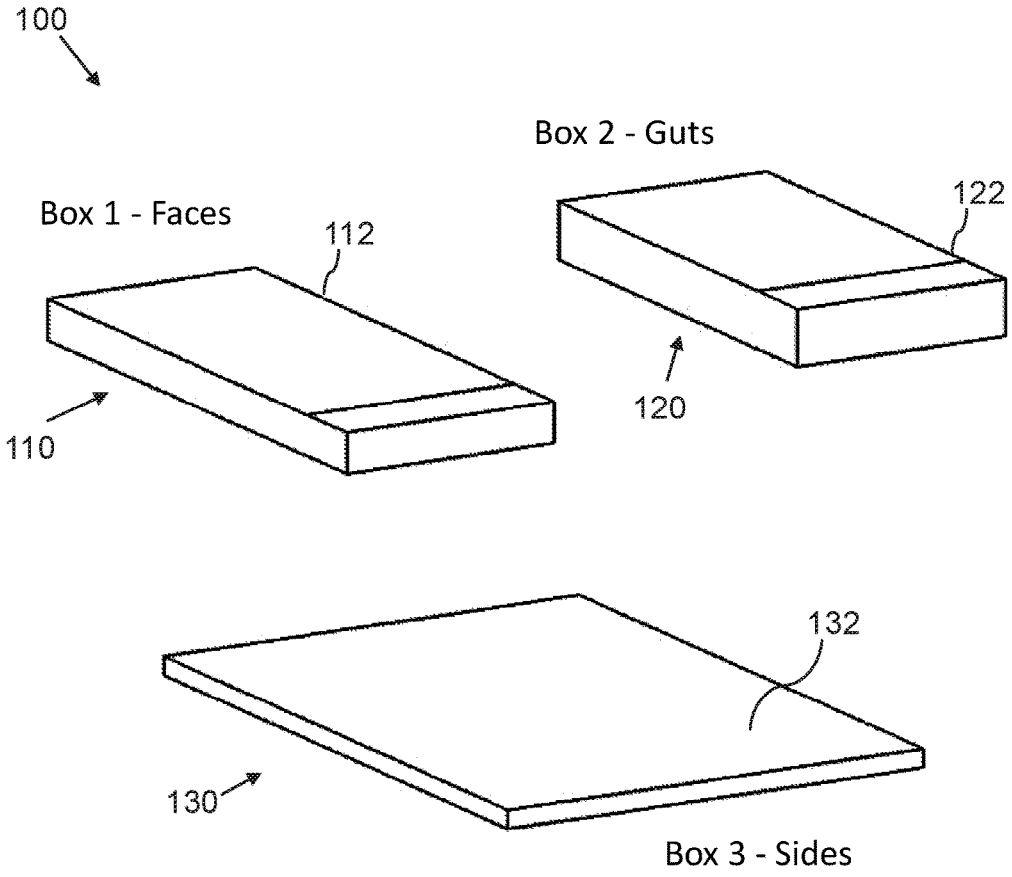
FIG. 1 is a perspective view of a flat packed furniture system in an initial configuration for shipping, according to an embodiment of the invention.
Figure 2A:
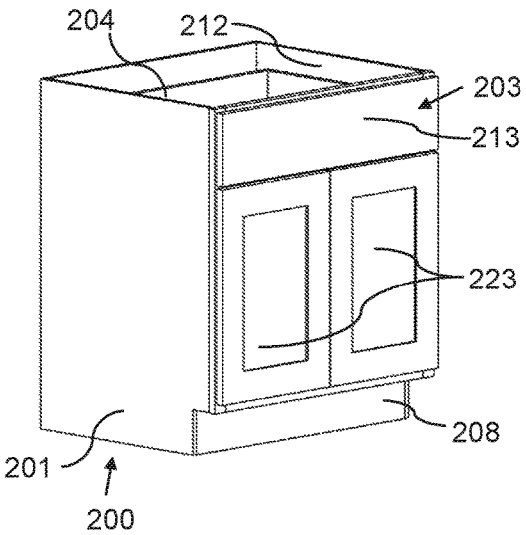
FIG. 2A is a left front perspective view of a furniture item assembled from the flat packed furniture system in an initial configuration for shipping, according to an embodiment of the invention.
Figure 2B:
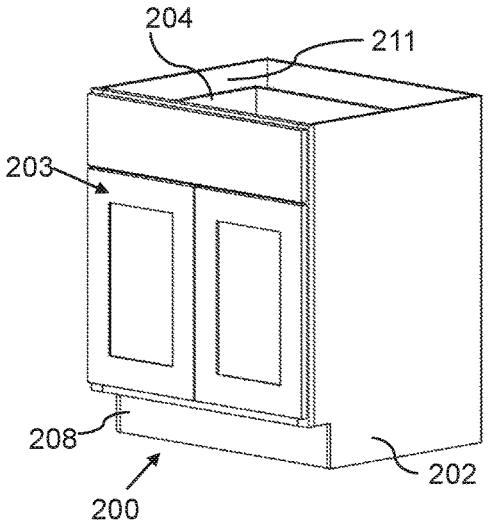
FIG. 2B is a right front perspective view of the furniture item shown in FIG. 2A.
Figure 2C:
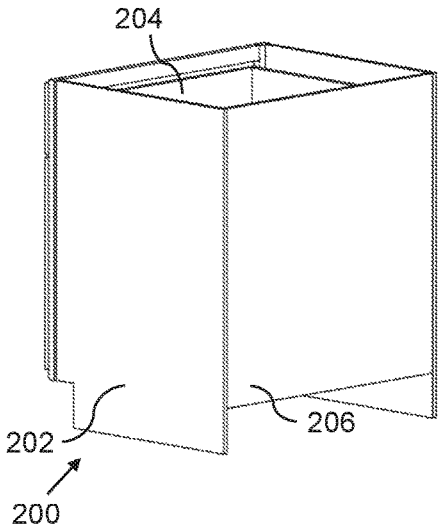
FIG. 2C is a right rear perspective view of the furniture item shown in FIG. 2A.
Figure 2D:
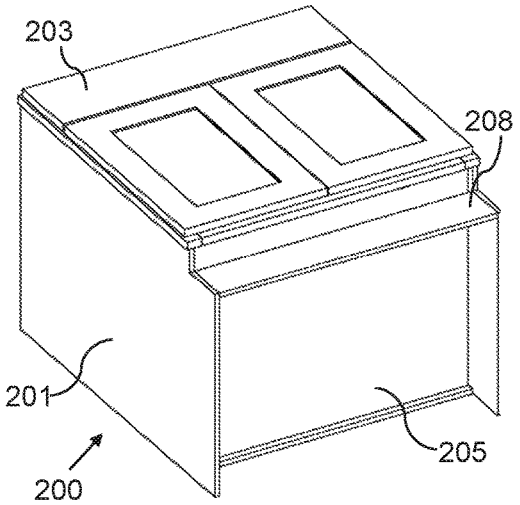
FIG. 2D is a left bottom perspective view of the furniture item shown in FIG. 2A.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

The final shape of many of the flat packet products when assembled are rectangular with 6 planes—left and right, front and back, and top and bottom. The standard packaging is 1 box per assembly or if the product is modular, 1 box per group of modular components.

The proposed invention is associated with the growing market requiring repacking of the modular flat packed product when it is assembled.

In the following, we describe the structure of an embodiment of a flat packed furniture system 100 with reference to FIG. 1, in such manner that like reference numerals refer to like components throughout; a convention that we shall employ for the remainder of this specification.

In an embodiment a flat packed furniture system 100, which also can be referred to as a modular flat packed furniture system 100, can comprise a plurality of boxes 110 120 130, such that each box 110 120 130 contains packaging pieces and parts for a furniture item, such that the plurality of parts from each box 110 120 130 can be assembled as the furniture item, and such that the packaging pieces from each box 110 120 130, can be reused as packaging for the furniture item.

Figure 3A:
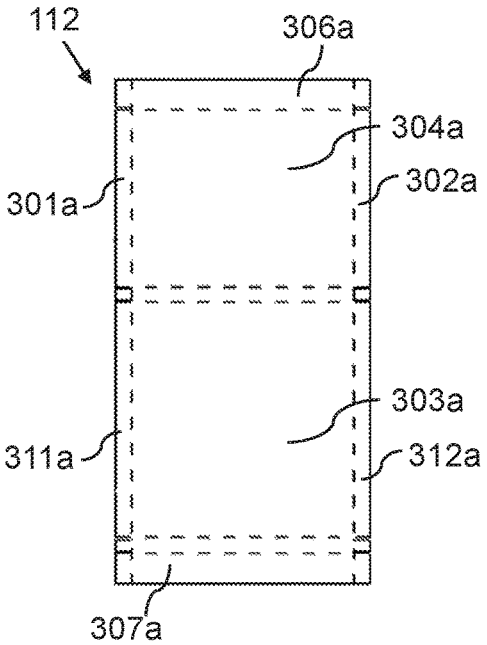
FIG. 3A is a top elevation view of a first packaging piece of the flat packed furniture system, according to an embodiment of the invention.
Figure 3B:
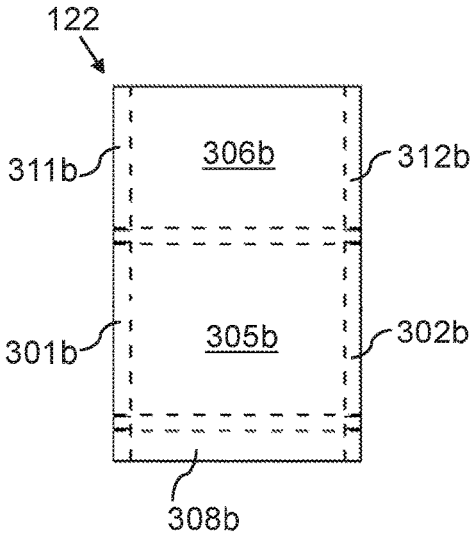
FIG. 3B is a top elevation view of a second packaging piece of the flat packed furniture system, according to an embodiment of the invention.
Figure 3C:
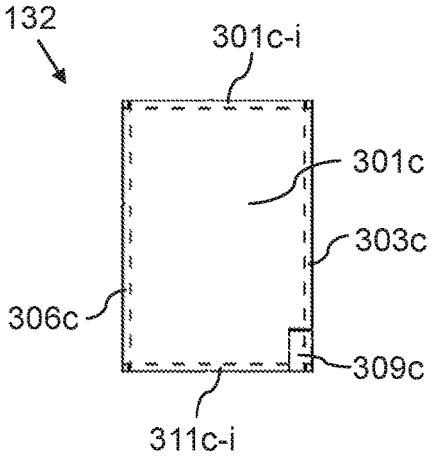
FIG. 3C is a top elevation view of a third packaging piece of the flat packed furniture system, according to an embodiment of the invention.
Figure 3D:
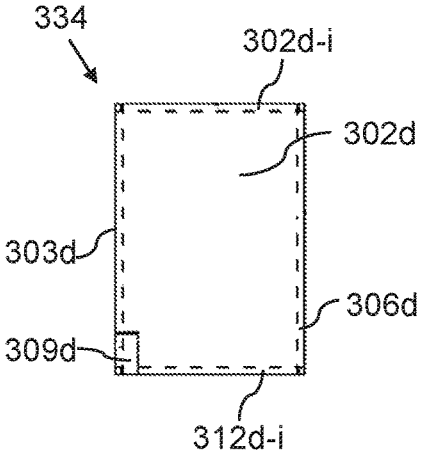
FIG. 3D is a top elevation view of a fourth packaging piece of the flat packed furniture system, according to an embodiment of the invention.
Figure 4A:
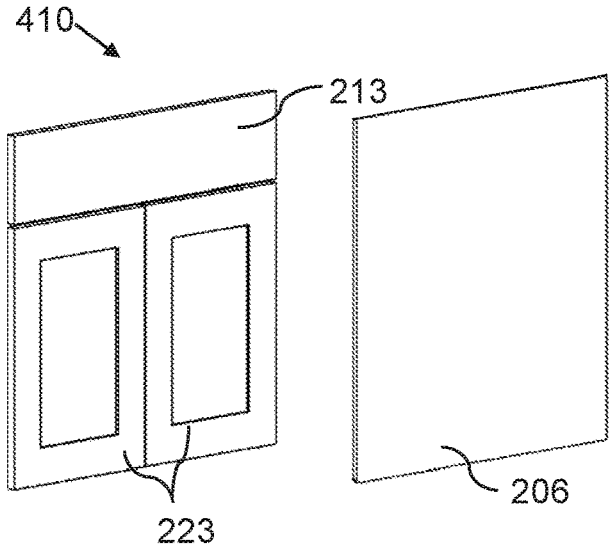
FIG. 4A is a perspective view of a first set of furniture parts of the flat packed furniture system, according to an embodiment of the invention.
Figure 4B:
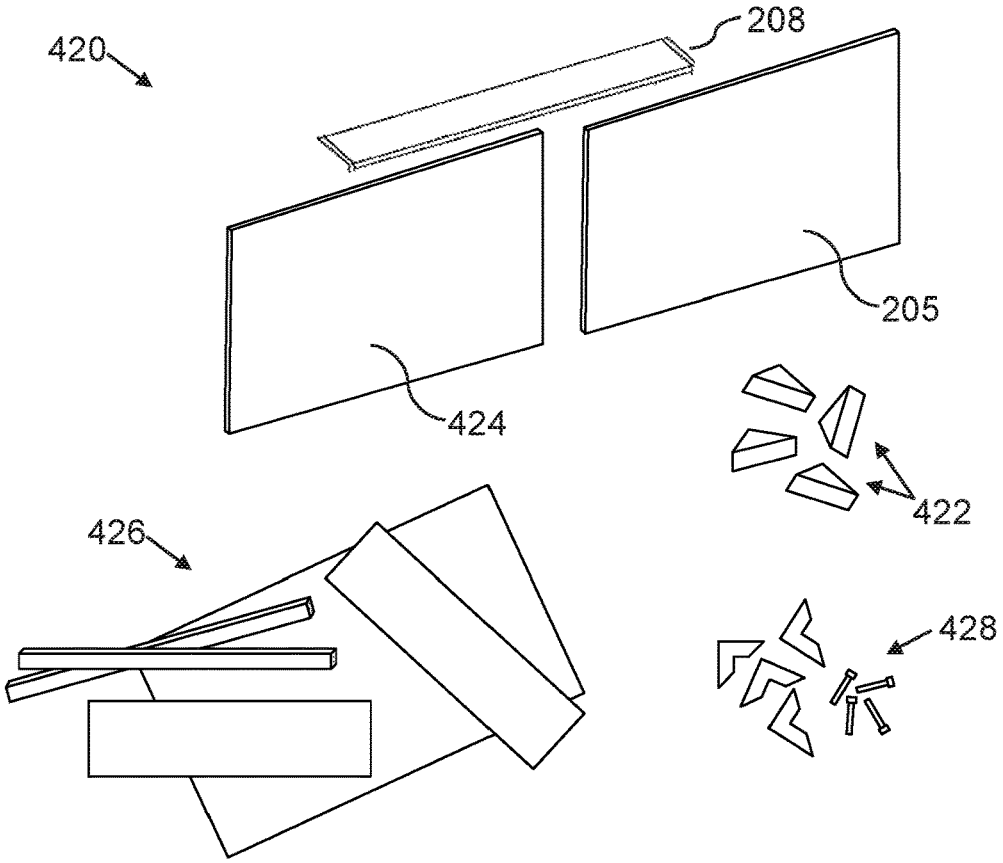
FIG. 4B is a perspective view of a second set of furniture parts of the flat packed furniture system, according to an embodiment of the invention.
Figure 4C:
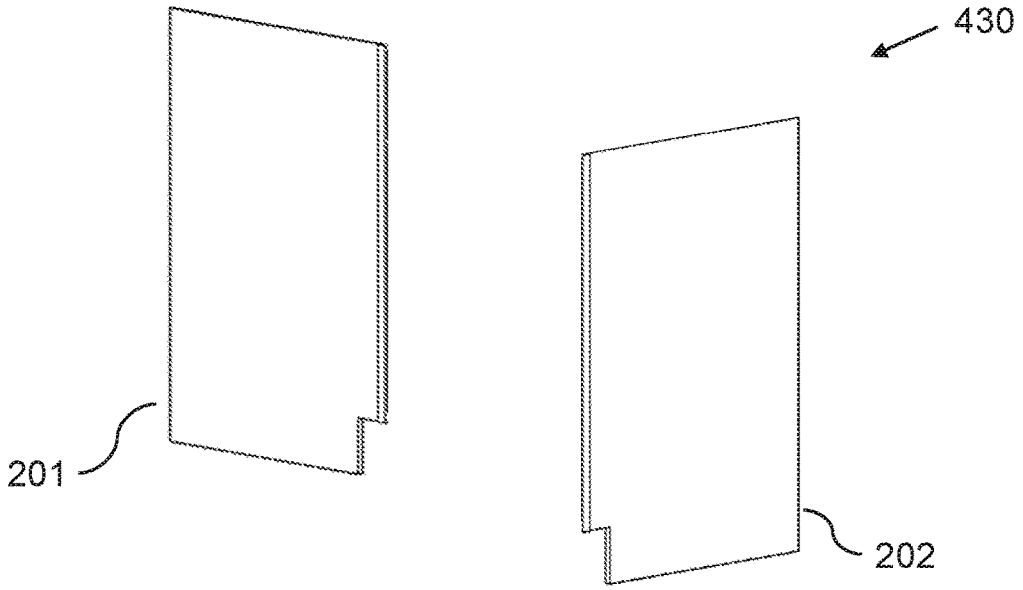
FIG. 4C is a perspective view of a third set of furniture parts of the flat packed furniture system, according to an embodiment of the invention.

In a related embodiment, as shown in FIGS. 1, 2A-2D, 3A-3D, and 4A-4D, a flat packed furniture system 100 can include:

a) A first box 110, which can include:
   i. A first packaging piece 112, as shown in FIGS. 1 and 3A; and
   ii. A first set of furniture parts 410, as shown in FIG. 4A, wherein the first set of furniture parts 410 is packaged inside the first packaging piece 112;

b) A second box 120, which can include:
   i. A second packaging piece 122, as shown in FIGS. 1 and 3B; and
   ii. A second set of furniture parts 420, as shown in FIG. 4B, wherein the second set of furniture parts 420 is packaged inside the second packaging piece 122;

c) A third box 130, which can include:
   i. a third packaging piece 132, as shown in FIGS. 1 and 3C;
   ii. a fourth packaging piece 334, as shown in FIG. 3D; and
   iii. A third set of furniture parts 430, as shown in FIG. 4C, wherein the third set of furniture parts 430 is packaged inside the third and fourth packaging pieces 132 334;

such that the third and fourth packaging pieces 132 334 are mounted on opposing sides, in a shoebox type configuration;

wherein the first, second, and third sets of furniture parts 410 420 430 are configured to be assemblable as an assembled furniture item 200;

such that the packaging pieces 112 122 132 334 are configured to be reused as packaging for the furniture item 200, such that the packaging pieces 112 122 132 334 are configured to cover outer surfaces of the assembled furniture item 200.

In related embodiments, the packaging pieces 112 122 132 334 can be flat pieces of cardboard, made of types of cardboard commonly used for boxes/packaging, but can also be made of other flat pieces made of materials suitable for packaging.

In related embodiments, the flat packed furniture system 100 can be configured such that the first, second, and third sets of furniture parts 410 420 430 are configured to be assemblable as a cabinet 200, which can include B30 and W1830 cabinet sizes, and other cabinet sizes and designs, including standardized and proprietary sizes and design.

In a related embodiment, the flat packed furniture system 100 can be configured such that:

a) the first set of furniture parts 410 can include face parts of a cabinet 200, including:
   i. a face panel 213, which is a part of a front side 203 of the cabinet 200;
   ii. doors 223, which are part of a front side 203 of the cabinet 200;
   iii. a back panel 206;
b) the second set of furniture parts 420 can include gut parts of a cabinet 200, including:
   i. optionally, a top panel 424;
   ii. a bottom panel 205;
   iii. a toe panel 208;
   iv. parts for drawer boxes 426;
   v. corner blocks 422; and
   vi. brackets, screws and other hardware 428;
c) the third set of furniture parts 430 can include side parts of a cabinet 200, including:
   iv. a right side 202; and
   v. a left side 201.

In related embodiments, the flat packed furniture system 100 is a modular packaging system adapted for reuse of packaging, such that flat packed furniture system 100 optimizes for both reduced storage/inventory cost and reduced packaging cost, such that when a manufacturer produces a portfolio of cabinets, including a first plurality, n, of cabinet models, each cabinet model including a second plurality, c, of color options, then the manufacturer must produce:

a) n different first sets of furniture parts 410, which are face parts, each in c different color options;
b) one second set of furniture parts 420, which are gut parts that are generic (i.e. the same) for all combinations of cabinet models and colors; and
c) c different third sets of furniture parts 430, which are side parts that are generic (i.e. the same) for all combinations of cabinet models, and only vary depending on the color option selection;

whereby when the manufacturer needs to produce/stock a new cabinet model, the manufacturer only needs to produce new versions of the first box 110 with a first set of furniture parts 410, since both the second and third boxes 120 130 with respectively second and third sets of furniture parts 420 430 are generic to the cabinet model version. Some high-end manufacturers package all parts in one large box, thereby maximizing storage/inventory cost and minimizing, and some mass market manufacturers will package a cabinet in a high number of boxes, such as for example nine boxes. The modular flat packed furniture system 100, uses a novel approach of separating parts in face parts, gut parts, and side parts, in respectively the first, second, and third boxes 110 120 130, and thereby optimizes for both minimal storage/inventory cost and for minimal packaging cost. The modular flat packed furniture system 100 further reduces packaging cost by facilitating reuse of the packaging pieces 112 122 132 334 of the first, second, and third boxes 110 120 130 for packaging of an assembled cabinet 200, in preparation for further shipment when the cabinet 200 has been assembled from the face, gut, side parts of respectively the first, second, and third boxes 110 120 130.

In a related embodiment, wherein the cabinet 200 is a B12 cabinet, the flat packed furniture system 100 can be configured such that:

a) the first box 110 can be 12" wide, 30" tall, and 2" deep;
b) the second box 120 can be 12" wide, 24" tall, and 3" deep;
c) the third box 130 can be 24" wide, 34½" tall, and 1" deep.

In a related embodiment, as shown in FIG. 3A, the first packaging piece 112 can be configured for packaging reuse, such that the first packaging piece 112 can include attach/fold pieces connected by perforated borders, including a) a top center attachment piece 304*a*, which is configured to be aligned with a top side 204 of the cabinet 200, such that the top center attachment piece 304*a* is positioned in a top center of the first packaging piece 112, between a top fold piece 306*a* and a bottom center attachment piece 303*a;*
b) a bottom center attachment piece 303*a*, which is configured to be aligned with a front face 203 of the cabinet 200, such that the bottom center attachment piece 303*a* is positioned in a bottom center of the first packaging piece 112, between the top center attachment piece 304*a* and bottom fold piece 307*a*, such that a bottom side of the top center attachment piece 304*a* is connected to a top side of the bottom center attachment piece 303*a*, via an intermediate fold piece;
c) a top fold piece 306*a*, which is configured to fold onto a back panel 206 of the cabinet 200, such that the top fold piece 306*a* is positioned in a top of the first packaging piece 112, and connected to a top side of the top center attachment piece 304*a;*
d) a top left side fold piece 301*a*, which is configured to fold onto a left side 201 of the cabinet 200, such that the top left side fold piece 301*a* is positioned in a top left side of the first packaging piece 112, and connected to a left side of the top center attachment piece 304*a;*
e) a top right side fold piece 302*a*, which is configured to fold onto a right side 202 of the cabinet 200, such that the top right side fold piece 302*a* is positioned in a top right side of the first packaging piece 112, and connected to a right side of the top center attachment piece 304*a;*
f) a bottom left side fold piece 311*a*, which is configured to fold onto a left side 201 of the cabinet 200, such that the bottom left side fold piece 311*a* is positioned in a bottom left side of the first packaging piece 112, and connected to a left side of the bottom center attachment piece 303*a;*
g) a bottom right side fold piece 312*a*, which is configured to fold onto a right side 202 of the cabinet 200, such that the bottom right side fold piece 312*a* is positioned in a bottom right side of the first packaging piece 112, and connected to a right side of the bottom center attachment piece 303*a*; and
h) a bottom fold piece 307*a*, which is configured to fold onto a bottom panel 205 of the cabinet 200, such that the bottom fold piece 307*a* is positioned in a bottom of the first packaging piece 112, and connected to a bottom side of the bottom center attachment piece 303*a*.

In a related embodiment, as shown in FIG. 3B, the second packaging piece 122 can be configured for packaging reuse, such that the second packaging piece 122 can include attach/fold pieces connected by perforated borders, including a) a top fold piece 306*b*, which is configured to be aligned with a back panel 206 of the cabinet 200,
such that the top fold piece 306*b* is positioned in a top of the second packaging piece 122, and connected to a top side of the center attachment piece 305*b;* b) a center attachment piece 305*b*, which is configured to be aligned with a bottom panel 205 of the cabinet 200,
such that the center attachment piece 305*b* is positioned in a center of the second packaging piece 122, between a top fold piece 306*b* and a bottom fold piece 308*b;* c) a bottom fold piece 308*b*, which is configured to fold onto a toe panel 208 of the cabinet 200,
such that the bottom fold piece 308*b* is positioned in a bottom of the second packaging piece 122, and connected to a bottom side of the center attachment piece 305*b;* d) a bottom right side fold piece 302*b*, which is configured to fold onto a right side 202 of the cabinet 200,
such that the bottom right side fold piece 302*b* is positioned in a bottom right side of the second packaging piece 122, and connected to a right side of the center attachment piece 305*b;* e) a bottom left side fold piece 301*b*, which is configured to fold onto a left side 201 of the cabinet 200,
such that the bottom left side fold piece 301*b* is positioned in a bottom left side of the second packaging piece 122, and connected to a left side of the center attachment piece 305*b;* f) a top right side fold piece 312*b*, which is configured to fold onto a right side 202 of the cabinet 200,
such that the top right side fold piece 312*b* is positioned in a top right side of the second packaging piece 122, and connected to a right side of the top fold piece 306*b*; and g) a top left side fold piece 311*b*, which is configured to fold onto a left side 201 of the cabinet 200,
such that the top left side fold piece 311*b* is positioned in a top left side of the second packaging piece 122, and connected to a left side of the top fold piece 306*b*.

In a related embodiment, as shown in FIG. 3C, the third packaging piece 132 can be configured for packaging reuse, such that the third packaging piece 132 can include attach/fold pieces connected by perforated borders, including a) a center attachment piece 301*c*, which is configured to be aligned with a left panel 201 of the cabinet 200, such that the center attachment piece 301*c* is positioned in a center of the third packaging piece 132, below a top fold piece 301*c-i* and above a bottom fold piece 311*c-i;* b) a top fold piece 301*c-i*, which is configured to fold back onto an inner side 211 of the left panel 201 of the cabinet 200, such that the top fold piece 301*c-i* is positioned in a top of the third packaging piece 132, and connected to a top side of the center attachment piece 301*c;* c) a left side fold piece 306*c*, which is configured to fold onto a back panel 206 of the cabinet 200,
such that the left side fold piece 306*c* is positioned in a left side of the third packaging piece 132, and connected to a left side of the center attachment piece 301*c;* d) a right side fold piece 303*c*, which is configured to fold onto a front side 203 of the cabinet 200,
such that the right side fold piece 303*c* is positioned in a right side of the third packaging piece 132, and connected to a right side of the center attachment piece 301*c;* e) a right bottom corner fold piece 309*c*, which is configured to fold onto a toe panel 208 of the cabinet 200,
such that the right bottom corner fold piece 309*c* is positioned in a right bottom corner of the third packaging piece 132, and connected to a right bottom corner of the center attachment piece 301*c*; and f) a bottom fold piece 311*c-i*, which is configured to fold back onto an inner side 211 of the left panel 201 of the cabinet 200,
such that the bottom fold piece 311*c-i* is positioned in a bottom of the third packaging piece 132, and connected to a bottom side of the center attachment piece 301*c*.

In a related embodiment, as shown in FIG. 3D, the fourth packaging piece 334 can be configured for packaging reuse, such that the fourth packaging piece 334 can include attach/fold pieces connected by perforated borders, including a) a center attachment piece 302*d*, which is configured to be aligned with a right panel 202 of the cabinet 200,
such that the center attachment piece 302*d* is positioned in a center of the fourth packaging piece 334, below a top fold piece 302*d-i* and above a bottom fold piece 312*d-i;* b) a top fold piece 302*d-i*, which is configured to fold back onto an inner side 212 of the right panel 202 of the cabinet 200,
such that the top fold piece 302*d-i* is positioned in a top of the fourth packaging piece 334, and connected to a top side of the center attachment piece 302*d;* c) a right side fold piece 306*d*, which is configured to fold onto a back panel 206 of the cabinet 200,
such that the right side fold piece 306*d* is positioned in a right side of the fourth packaging piece 334, and connected to a right side of the center attachment piece 302*d;* d) a left side fold piece 303*d*, which is configured to fold onto a front side 203 of the cabinet 200,
such that the left side fold piece 303*d* is positioned in a left side of the fourth packaging piece 334, and connected to a left side of the center attachment piece 302*d;* e) a left bottom corner fold piece 309*d*, which is configured to fold onto a toe panel 208 of the cabinet 200,
such that the left bottom corner fold piece 309*d* is positioned in a left bottom corner of the fourth packaging piece 334, and connected to a left bottom corner of the center attachment piece 302*d*; and f) a bottom fold piece 312*d-i*, which is configured to fold back onto an inner side 212 of the right panel 202 of the cabinet 200,
such that the bottom fold piece 312*d-i* is positioned in a bottom of the fourth packaging piece 334, and connected to a bottom side of the center attachment piece 302*d*.

In a further related embodiment, FIGS. 6A, 6B, 6C, and 6D shows the first, second, third, and fourth packaging pieces 112 122 132 334 used for packaging reuse, such that the cabinet 200 is packaged with the first, second, third, and fourth packaging pieces 112 122 132 334, to form a repackaged cabinet 600. The perspective views of FIGS. 6A, 6B, 6C, and 6D correspond substantially to the views of FIGS. 6A, 6B, 6C, and 6D, respectively, with the first, second, third, and fourth packaging pieces 112 122 132 334 added.

In related embodiments, when the first, second, third, and fourth packaging pieces 112 122 132 334 are used for packaging reuse to package the assembled cabinet 200, the first, second, third, and fourth packaging pieces 112 122 132 334 can be secured using packaging tape, staples, and/or other packaging fasteners.

In a related embodiment, as shown in FIGS. 6A, 6B, 6C, and 6D:

a) The third and fourth packaging pieces 132 334 can be attached to the cabinet first, for example using tape and/or staples, such that the third and fourth packaging pieces 132 334 are innermost positioned;

b) The second packaging piece 122 can be attached next, for example using tape and/or staples, and partially overlapping the third and fourth packaging pieces 132 334, such that the second packaging piece 122 is intermediately positioned; and c) The first packaging piece 112 can be attached lastly, for example using tape and/or staples, and partially overlapping the third, fourth, and second packaging pieces 132 334 122, such that the first packaging piece 112 is outermost positioned.

Figure 5A:
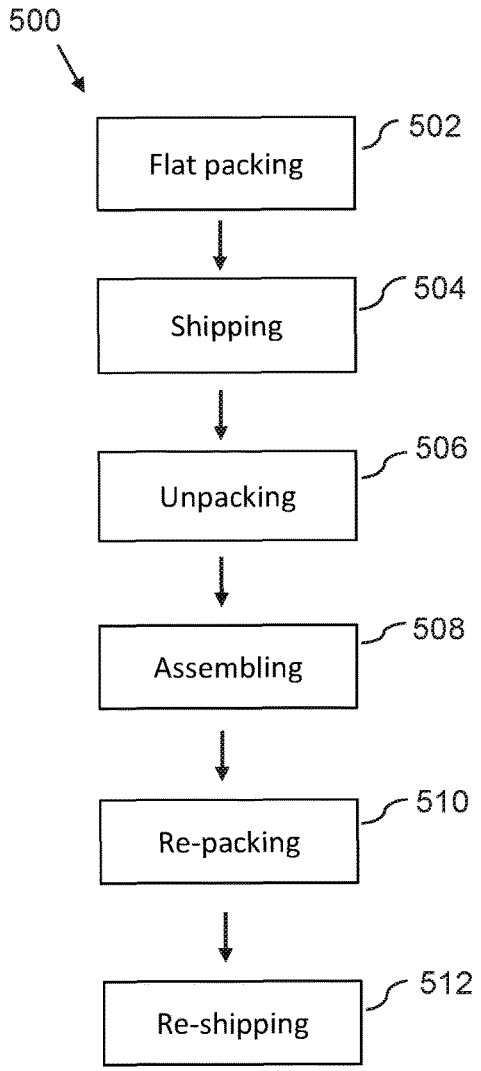
FIG. 5A is a flowchart illustrating steps that may be followed, in accordance with one embodiment of a method or process of flat packing furniture.
Figure 5B:
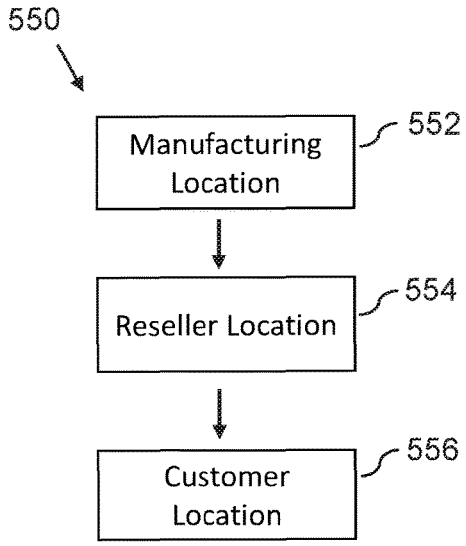
FIG. 5B is a flowchart illustrating a sequence of locations, in accordance with one embodiment of a method or process of flat packing furniture.
Figure 6A:
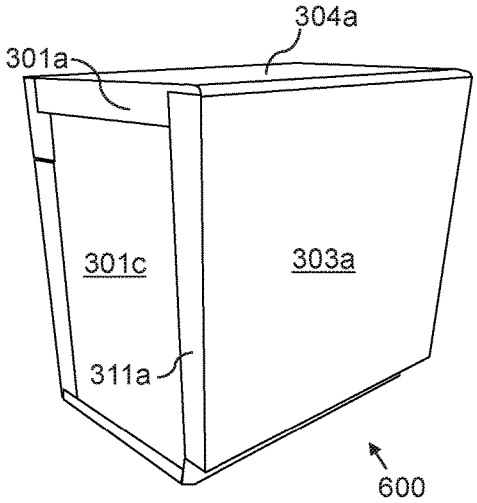
FIG. 6A is a left front perspective view of a furniture item assembled from the flat packed furniture system in an initial configuration for shipping and packaged with reused packaging pieces, according to an embodiment of the invention.
Figure 6B:
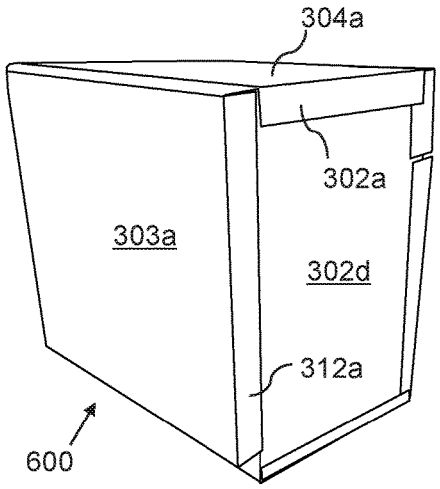
FIG. 6B is a right front perspective view of the furniture item packaged with reused packaging pieces shown in FIG. 6A.
Figure 6C:
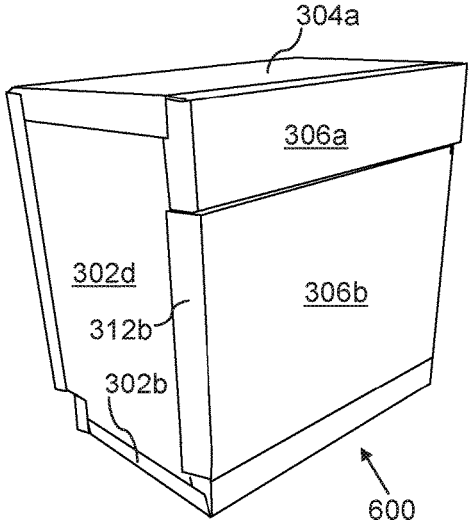
FIG. 6C is a right rear perspective view of the furniture item packaged with reused packaging pieces shown in FIG. 6A.
Figure 6D:
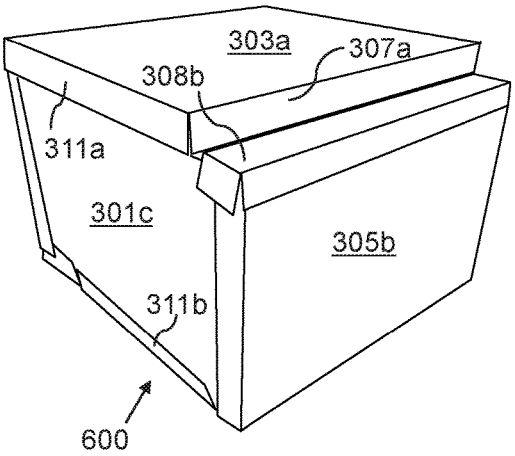
FIG. 6D is a left bottom perspective view of the furniture item packaged with reused packaging pieces shown in FIG. 6A.

In an embodiment, as illustrated in FIGS. 5A and 5B, a method for flat packing furniture 500, can include:

a) Flat packing a furniture item 502, wherein a plurality of parts for a furniture item 200 are flat packaged inside a plurality of packaging pieces 112 122 132 334, producing a plurality of boxes 110 120 130;

b) Shipping the flat packed furniture item 504, wherein the plurality of boxes is shipped from a manufacturing location 552 to a reseller location 554, as shown in FIG. 5B, showing the sequence of locations 550;

c) Unpacking the flat packed furniture item 506, wherein the plurality of parts, comprising a plurality of sets of furniture parts, is unpackaged from the plurality of boxes;

d) Assembling the furniture item 508, wherein the furniture 200 item is assembled from the plurality of parts, to form an assembled furniture item 200;

e) Re-packing the furniture item 510, wherein the assembled furniture item 200 is re-packaged with the plurality of packaging pieces 112 122 132 334, to form a repackaged furniture item 600; and f) Re-shipping the furniture item 512, wherein the repackaged furniture item 600 is shipped from the reseller location 554 to a customer location 556.

Here has thus been described a multitude of embodiments of the flat packed furniture system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A flat packed furniture system, comprising:

a plurality of boxes, comprising:

a first box, comprising:

a first packaging piece; and a first set of furniture parts, wherein the first set of furniture parts is flat packed inside the first packaging piece;

a second box, comprising:

a second packaging piece; and a second set of furniture parts, wherein the second set of furniture parts is flat packed inside the second packaging piece; and a third box, comprising:

a third packaging piece;

a fourth packaging piece; and a third set of furniture parts, wherein the third set of furniture parts is flat packed inside the third and fourth packaging pieces;

wherein the first, second, and third sets of furniture parts are configured to be assemblable as a furniture item;

such that the packaging pieces are configured to be reused as packaging for the furniture item, such that the packaging pieces are configured to cover outer surfaces of the furniture item;

wherein the furniture item is a cabinet, wherein the first packaging piece comprises first connected pieces, comprising:

a top center attachment piece, which is configured to be aligned with a top side of the cabinet;

a first bottom center attachment piece, which is configured to be aligned with a front face of the cabinet, such that a bottom side of the top center attachment piece is connected to a top side of the first bottom center attachment piece;

a first top fold piece, which is configured to fold onto a back panel of the cabinet, such that the top fold piece is connected to a top side of the top center attachment piece;

a top left side fold piece, which is configured to fold onto a left side of the cabinet, such that the top left side fold piece is connected to a left side of the top center attachment piece;

a first top right side fold piece, which is configured to fold onto a right side of the cabinet, such that the first top right side fold piece is connected to a right side of the top center attachment piece;

a first bottom left side fold piece, which is configured to fold onto the left side of the cabinet, such that the first bottom left side fold piece is connected to a left side of the first bottom center attachment piece;

a first bottom right side fold piece, which is configured to fold onto the right side of the cabinet, such that the first bottom right side fold piece is connected to a right side of the first bottom center attachment piece; and a first bottom fold piece, which is configured to fold onto a bottom panel of the cabinet, such that the first bottom fold piece is connected to a bottom side of the first bottom center attachment piece.

2. The flat packed furniture system of claim 1, wherein the furniture item is a cabinet, and wherein:

a) the first set of furniture parts comprises face parts of the cabinet, comprising:

a face panel, which is a part of a front side of the cabinet;

doors, which are part of the front side of the cabinet; and a back panel;

b) the second set of furniture parts comprises gut parts of the cabinet, comprising:

a bottom panel;

a toe panel; and parts for drawer boxes; and c) the third set of furniture parts comprises side parts of a cabinet, comprising:

a right side; and a left side.

3. The flat packed furniture system of claim 2, wherein the second set of furniture parts further comprises a top panel.

4. The flat packed furniture system of claim 1, wherein the cabinet is a B12 cabinet, wherein:

a) the first box is 12" wide, 30" tall, and 2" deep;

b) the second box is 12" wide, 24" tall, and 3" deep; and c) the third box is 24" wide, 34½" tall, and 1" deep.

5. The flat packed furniture system of claim 1, wherein the connected pieces are connected by perforated borders.

6. The flat packed furniture system of claim 1, wherein the second packaging piece comprises second connected pieces, comprising:

a) a second bottom center attachment piece, which is configured to be aligned with the bottom panel of the cabinet;

b) a second top fold piece, which is configured to be aligned with the back panel of the cabinet, such that the second top fold piece is connected to the top side of the second bottom center attachment piece;

c) a second bottom fold piece, which is configured to fold onto a toe panel of the cabinet, such that the second bottom fold piece is connected to a bottom side of the second bottom center attachment piece;

d) a second bottom right side fold piece, which is configured to fold onto the right side of the cabinet, such that the second bottom right side fold piece is connected to a right side of the second bottom center attachment piece;

e) a second bottom left side fold piece, which is configured to fold onto the left side of the cabinet, such that the second bottom left side fold piece is connected to a left side of the second bottom center attachment piece;

f) a second top right side fold piece, which is configured to fold onto the right side of the cabinet, such that the second top right side fold piece is connected to a right side of the second top fold piece; and g) a top left side fold piece, which is configured to fold onto the left side of the cabinet, such that the top left side fold piece is connected to a left side of the second top fold piece.

7. The flat packed furniture system of claim 1, wherein the furniture item is a cabinet, wherein the third packaging piece comprises second connected pieces, comprising:

a) a left center attachment piece, which is configured to be aligned with a left panel of the cabinet;

b) a second top fold piece, which is configured to fold back onto an inner side of the left panel of the cabinet, such that the first top fold piece is connected to a top side of the left center attachment piece;

c) a back left side fold piece, which is configured to fold onto a back panel of the cabinet, such that the back left side fold piece is connected to a left side of the left center attachment piece;

d) a right side front fold piece, which is configured to fold onto a front side of the cabinet, such that the right side front fold piece is connected to a right side of the left center attachment piece; and e) a bottom inner fold piece, which is configured to fold back onto an inner side of the left panel of the cabinet, such that the bottom inner fold piece is connected to a bottom side of the left center attachment piece.

8. The flat packed furniture system of claim 1, wherein the fourth packaging piece comprises second connected pieces, comprising:

a) a right center attachment piece, which is configured to be aligned with the right panel of the cabinet;

b) a second top fold piece, which is configured to fold back onto an inner side of the right panel of the cabinet, such that the second top fold piece is connected to a top side of the right center attachment piece;

c) a back right side fold piece, which is configured to fold onto the back panel of the cabinet, such that the back right side fold piece is connected to a right side of the right center attachment piece;

d) a front left side fold piece, which is configured to fold onto a front side of the cabinet, such that the front left side fold piece is connected to a left side of the right center attachment piece; and e) a bottom inner fold piece, which is configured to fold back onto the inner side of the right panel of the cabinet, such that the bottom inner fold piece is connected to a bottom side of the right center attachment piece.

9. A flat packed furniture system, comprising:

a plurality of boxes, comprising:

a first box, comprising:

a first packaging piece; and a first set of furniture parts, wherein the first set of furniture parts is flat packed inside the first packaging piece;

a second box, comprising:

a second packaging piece; and a second set of furniture parts, wherein the second set of furniture parts is flat packed inside the second packaging piece; and a third box, comprising:

a third packaging piece;

a fourth packaging piece; and a third set of furniture parts, wherein the third set of furniture parts is flat packed inside the third and fourth packaging pieces;

wherein the first, second, and third sets of furniture parts are configured to be assemblable as a furniture item;

such that the packaging pieces are configured to be reused as packaging for the furniture item, such that the packaging pieces are configured to cover outer surfaces of the furniture item;

wherein the furniture item is a cabinet, wherein the second packaging piece comprises connected pieces, comprising:

a bottom center attachment piece, which is configured to be aligned with a bottom panel of the cabinet;

a top fold piece, which is configured to be aligned with a back panel of the cabinet, such that the top fold piece is connected to a top side of the bottom center attachment piece;

a bottom fold piece, which is configured to fold onto a toe panel of the cabinet, such that the bottom fold piece is connected to a bottom side of the bottom center attachment piece;

a bottom right side fold piece, which is configured to fold onto a right side of the cabinet, such that the bottom right side fold piece is connected to a right side of the bottom center attachment piece;

a bottom left side fold piece, which is configured to fold onto a left side of the cabinet, such that the bottom left side fold piece is connected to a left side of the bottom center attachment piece;

a top right side fold piece, which is configured to fold onto a right side of the cabinet, such that the top right side fold piece is connected to a right side of the top fold piece; and a top left side fold piece, which is configured to fold onto a left side of the cabinet, such that the top left side fold piece is connected to a left side of the top fold piece.

10. The flat packed furniture system of claim 9, wherein the furniture item is a cabinet, and wherein:

a) the first set of furniture parts comprises face parts of the cabinet, comprising:

a face panel, which is a part of a front side of the cabinet;

doors, which are part of the front side of the cabinet; and a back panel;

b) the second set of furniture parts comprises gut parts of the cabinet, comprising:

a bottom panel;

a toe panel; and parts for drawer boxes; and c) the third set of furniture parts comprises side parts of a cabinet, comprising:

a right side; and a left side.

11. The flat packed furniture system of claim 10, wherein the second set of furniture parts further comprises a top panel.

12. The flat packed furniture system of claim 9, wherein the cabinet is a B12 cabinet, wherein:

a) the first box is 12" wide, 30" tall, and 2" deep;

b) the second box is 12" wide, 24" tall, and 3" deep; and c) the third box is 24" wide, 34½" tall, and 1" deep.

13. The flat packed furniture system of claim 9, wherein the connected pieces are connected by perforated borders.

14. A flat packed furniture system, comprising:

a plurality of boxes, comprising:

a first box, comprising:

a first packaging piece; and a first set of furniture parts, wherein the first set of furniture parts is flat packed inside the first packaging piece;

a second box, comprising:

a second packaging piece; and a second set of furniture parts, wherein the second set of furniture parts is flat packed inside the second packaging piece; and a third box, comprising:

a third packaging piece;

a fourth packaging piece; and a third set of furniture parts, wherein the third set of furniture parts is flat packed inside the third and fourth packaging pieces;

wherein the first, second, and third sets of furniture parts are configured to be assemblable as a furniture item; such that the packaging pieces are configured to be reused as packaging for the furniture item, such that the packaging pieces are configured to cover outer surfaces of the furniture item;

wherein the furniture item is a cabinet, wherein the third packaging piece comprises connected pieces, comprising:

a center attachment piece, which is configured to be aligned with a left panel of the cabinet;

a top fold piece, which is configured to fold back onto an inner side of the left panel of the cabinet, such that the top fold piece is connected to a top side of the center attachment piece;

a left side fold piece, which is configured to fold onto a back panel of the cabinet, such that the left side fold piece is connected to a left side of the center attachment piece;

a right side fold piece, which is configured to fold onto a front side of the cabinet, such that the right side fold piece is connected to a right side of the center attachment piece; and a bottom fold piece, which is configured to fold back onto an inner side of the left panel of the cabinet, such that the bottom fold piece is connected to a bottom side of the center attachment piece.

15. The flat packed furniture system of claim 14, wherein the furniture item is a cabinet, and wherein:

a) the first set of furniture parts comprises face parts of the cabinet, comprising:

a face panel, which is a part of a front side of the cabinet;

doors, which are part of the front side of the cabinet; and a back panel;

b) the second set of furniture parts comprises gut parts of the cabinet, comprising:

a bottom panel;

a toe panel; and parts for drawer boxes; and c) the third set of furniture parts comprises side parts of a cabinet, comprising:

a right side; and a left side.

16. The flat packed furniture system of claim 15, wherein the second set of furniture parts further comprises a top panel.

17. The flat packed furniture system of claim 14, wherein the cabinet is a B12 cabinet, wherein:

a) the first box is 12" wide, 30" tall, and 2" deep;

b) the second box is 12" wide, 24" tall, and 3" deep; and c) the third box is 24" wide, 34½" tall, and 1" deep.

18. The flat packed furniture system of claim 14, wherein the connected pieces are connected by perforated borders.

19. A flat packed furniture system, comprising:

a plurality of boxes, comprising:

a first box, comprising:

a first packaging piece; and a first set of furniture parts, wherein the first set of furniture parts is flat packed inside the first packaging piece;

a second box, comprising:

a second packaging piece; and a second set of furniture parts, wherein the second set of furniture parts is flat packed inside the second packaging piece; and a third box, comprising:

a third packaging piece;

a fourth packaging piece; and a third set of furniture parts, wherein the third set of furniture parts is flat packed inside the third and fourth packaging pieces;

wherein the first, second, and third sets of furniture parts are configured to be assemblable as a furniture item;

such that the packaging pieces are configured to be reused as packaging for the furniture item, such that the packaging pieces are configured to cover outer surfaces of the furniture item;

wherein the furniture item is a cabinet, wherein the fourth packaging piece comprises connected pieces, comprising:

a center attachment piece, which is configured to be aligned with a right panel of the cabinet;

a top fold piece, which is configured to fold back onto an inner side of the right panel of the cabinet, such that the top fold piece is connected to a top side of the center attachment piece;

a right side fold piece, which is configured to fold onto a back panel of the cabinet, such that the right side fold piece is connected to a right side of the center attachment piece;

a left side fold piece, which is configured to fold onto a front side of the cabinet, such that the left side fold piece is connected to a left side of the center attachment piece; and a bottom fold piece, which is configured to fold back onto an inner side of the right panel of the cabinet, such that the bottom fold piece is connected to a bottom side of the center attachment piece.

20. The flat packed furniture system of claim 19, wherein the furniture item is a cabinet, and wherein:

a) the first set of furniture parts comprises face parts of the cabinet, comprising:

a face panel, which is a part of a front side of the cabinet;

doors, which are part of the front side of the cabinet; and a back panel;

b) the second set of furniture parts comprises gut parts of the cabinet, comprising:

a bottom panel;

a toe panel; and parts for drawer boxes; and c) the third set of furniture parts comprises side parts of a cabinet, comprising:

a right side; and a left side.

21. The flat packed furniture system of claim 20, wherein the second set of furniture parts further comprises a top panel.

22. The flat packed furniture system of claim 19, wherein the cabinet is a B12 cabinet, wherein:

a) the first box is 12" wide, 30" tall, and 2" deep;

b) the second box is 12" wide, 24" tall, and 3" deep; and c) the third box is 24" wide, 34½" tall, and 1" deep.

23. The flat packed furniture system of claim 19, wherein the connected pieces are connected by perforated borders.

* * * * *